US011135798B2

(12) United States Patent
Burström et al.

(10) Patent No.: US 11,135,798 B2
(45) Date of Patent: Oct. 5, 2021

(54) METHOD FOR PROCESSING ARTICLES AND METHOD FOR HIGH-PRESSURE TREATMENT OF ARTICLES

(71) Applicant: Quintus Technologies AB, Vasteras (SE)

(72) Inventors: Per Burström, Vasteras (SE); Roger Thunholm, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 0 days.

(21) Appl. No.: 16/960,183

(22) PCT Filed: Feb. 5, 2018

(86) PCT No.: PCT/EP2018/052767
§ 371 (c)(1),
(2) Date: Jul. 6, 2020

(87) PCT Pub. No.: WO2019/149377
PCT Pub. Date: Aug. 8, 2019

(65) Prior Publication Data

US 2020/0376791 A1 Dec. 3, 2020

(51) Int. Cl.
*B30B 11/00* (2006.01)
*B22F 3/15* (2006.01)
(Continued)

(52) U.S. Cl.
CPC ..... *B30B 11/002* (2013.01); *B22F 3/15* (2013.01); *B22F 3/003* (2013.01);
(Continued)

(58) Field of Classification Search
None
See application file for complete search history.

(56) References Cited

U.S. PATENT DOCUMENTS 6,512,208 B1 1/2003 Bergman
2003/0197295 A1 10/2003 Nakai et al.
(Continued)

FOREIGN PATENT DOCUMENTS

JP S5935604 A 2/1984
JP S62-240716 A 10/1987
(Continued)

OTHER PUBLICATIONS

English-language translation of Korean Office Action dated Sep. 9, 2020 for corresponding Korean Application No. 10-2020-7013703.
(Continued)

*Primary Examiner* — Anthony M Liang
(74) *Attorney, Agent, or Firm* — Harness, Dickey & Pierce, P.L.C.

(57) ABSTRACT

A method for processing at least one article in a pressing arrangement is provided. The method comprises the steps of: increasing the temperature in the load compartment by the at least one heating element in the furnace chamber; maintaining the increased temperature at a predetermined temperature level, $T_1$, for a selected period of time, $t_1$; and during the steps of increasing the temperature and maintaining the increased temperature, circulating the pressure medium within the pressure vessel by the at least one flow generator.

12 Claims, 6 Drawing Sheets

(51) Int. Cl.
*B22F 3/00* (2021.01)
*B30B 15/34* (2006.01)

(52) U.S. Cl.
CPC ..... *B22F 2003/153* (2013.01); *B22F 2998/10* (2013.01); *B30B 15/34* (2013.01)

(56) References Cited

U.S. PATENT DOCUMENTS

| | | | |
|---|---|---|---|
| 2007/0228596 | A1 | 10/2007 | Fujikawa et al. |
| 2013/0344451 | A1 | 12/2013 | Gardin |
| 2014/0127637 | A1 | 5/2014 | Gardin |
| 2016/0039163 | A1 | 2/2016 | Nakai et al. |

FOREIGN PATENT DOCUMENTS

| | | | |
|---|---|---|---|
| JP | H11-83338 | A | 3/1999 |
| JP | 2014-89041 | A | 5/2014 |

OTHER PUBLICATIONS

International Search Report form PCT/ISA/210 for International Application No. PCT/EP2018/052767 dated Nov. 6, 2018.
International Preliminary Report on Patentability form PCT/IPEA/409 for International Application No. PCT/EP2018/052767 dated Jan. 23, 2020.
Office Action dated Dec. 22, 2020 issued in corresponding Japanese Patent Application No. 2020-522894.

METHOD FOR PROCESSING ARTICLES AND METHOD FOR HIGH-PRESSURE TREATMENT OF ARTICLES

This application is a national phase under 35 U.S.C. § 371 of PCT International Application No. PCT/EP2018/052767 which has an International filing date of Feb. 5, 2018, the entire contents of each of which are hereby incorporated by reference.

TECHNICAL FIELD

The present invention generally relates to the field of pressure treatment. In particular, the present invention relates to a method for increasing and maintaining the temperature during a treatment of articles and/or products by means of hot pressing, such as, for example, hot isostatic pressing (HIP).

BACKGROUND

Hot isostatic pressing (HIP) is a technology that finds more and more widespread use. HIP may for example be used for reducing or even eliminating porosity in castings (e.g., turbine blades) in order to substantially increase their service life and strength (e.g., their fatigue strength). HIP may in addition be used in manufacturing of products by means of compressing powder, wherein the powder is canned in sheet metal capsules, giving the product the desired shape. HIP is of particular interest for providing products which are desired or required to be fully, or substantially fully, dense, and to have pore-free, or substantially pore-free, outer surfaces, etc.

An article to be subjected to pressure treatment by HIP may be positioned in a load compartment or chamber of a thermally insulated pressure vessel. A treatment cycle may comprise loading the article, treating the article, and unloading the article. Several articles may be treated simultaneously. The treatment cycle may be divided into several parts, or phases, such as a pressing phase, a heating phase, and a cooling phase. After loading an article into the pressure vessel, it may then be sealed, followed by introduction of a pressure medium (e.g., comprising an inert gas such as Argon-containing gas) into the pressure vessel and the load compartment thereof. The pressure and temperature of the pressure medium is then increased, such that the article is subjected to an increased pressure and an increased temperature during a selected period of time. The increase in temperature of the pressure medium, which in turn may cause an increase in temperature of the article, is provided by means of a heating element or furnace arranged in a furnace chamber of the pressure vessel. The pressures, temperatures and treatment times may for example depend on the desired or required material properties of the treated article, the particular field of application, and the required quality of the treated article. Pressures in HIP may for example be in the range from 200 bar to 5000 bar, such as from 800 bar to 2000 bar. Temperatures in HIP may for example be in the range from 300° C. to 3000° C., such as from 500° C. to 2000° C.

Autoclaves with hot gas recirculation using natural convection are known from the state of the art, whereby the pressure distribution in the autoclave due to temperature differences that are present or required (heating or cooling on outer walls) can be used. In the autoclaves, cooler fluids drop downward and hotter fluids rise, following the laws of thermodynamics. During the heating, the heating element or furnace in the furnace chamber initiate a flow of the pressure medium, wherein the flow may depend on the arrangement of the heating element or furnace.

It will be appreciated that characteristics of a temperature increase and maintenance of the increased temperature in the pressure vessel may affect the metallurgical properties of the treated article. Inhomogeneous heating may, for example, lead to internal stresses in the articles or products, an uneven treatment of articles or products arranged in different places in the load compartment, a difficulty to control the heating, etc. Hence, it is generally desired to be able to provide a homogeneous heating, and also, if possible, to be able to control the heating and/or the heating rate. For example, it may be required or desired to increase and to maintain the temperature of the pressure medium (and thereby of the article) without causing large temperature variations within the load compartment. However, it should be noted that prior art arrangements and methods as previously described may suffer from relatively large temperature differences in the pressure vessel during operation. This is particularly a concern in the development of larger pressing arrangements for the ability to treat larger and/or or more articles and/or products for reasons of cost and/or efficiency, as prior art techniques used in relatively large pressing arrangements may lead to larger and/or more frequently occurring temperature differences in the load compartment during operation of the pressing arrangement.

Hence, there is a wish to improve the heating phase in the treatment of articles and/or products, and in particular in a pressing arrangement for hot isostatic pressing, such that a (substantially) uniform heating may be achieved.

SUMMARY

In view of the above, a concern of the present invention is to provide a method for processing at least one article in a pressing arrangement, for example by means of HIP, wherein a (substantially) homogeneous heating in the load compartment of the pressing arrangement can be obtained during a heating and/or holding phase of a treatment cycle.

To address at least one of these concerns and other concerns, a method in accordance with the independent claim is provided. Preferred embodiments are defined by the dependent claims.

According to a first aspect of the invention there is provided a method for processing at least one article in a pressing arrangement. The pressing arrangement comprises a pressure vessel comprising a pressure cylinder, and a furnace chamber arranged within the pressure vessel for heating a pressure medium. The furnace chamber comprises at least one heating element, and a load compartment for holding the at least one article, wherein the load compartment is arranged inside the furnace chamber. The pressing arrangement further comprises at least one flow generator for circulating pressure medium within the pressure vessel. The method comprises the step of increasing the temperature in the load compartment by the at least one heating element in the furnace chamber. The method further comprises the step of maintaining the increased temperature at a predetermined temperature level for a selected period of time. During the steps of increasing the temperature and maintaining the increased temperature, the method further comprises the step of circulating the pressure medium within the pressure vessel by the at least one flow generator.

Hence, the present invention is based on the idea of providing a method for processing one or more articles in a pressing arrangement, e.g. capable of carrying out pressure treatment of articles for example by means of HIP. The method may increase the temperature in the load compartment wherein the article(s) are arranged, and operate at least one flow generator during this increase in temperature for circulating the pressure medium within the pressure vessel. Furthermore, when a predetermined or desired temperature is reached within the load compartment, the method may maintain this temperature during a predetermined or desired time period during which the at least one flow generator is operated for circulating the pressure medium within the pressure vessel. Hence, during the first sub-phase of increasing the temperature in the load compartment and the subsequent, second sub-phase of maintaining the increased temperature in the load compartment, the forced convection in the pressing arrangement by operating the flow generator(s) of the pressing arrangement of the method may obtain an (at least substantially) uniform heating within the load compartment.

The present invention is advantageous in that the operation of the flow generator(s) both during the heating phase, in which the temperature is increased in the load compartment, as well as during the holding phase, in which the increased temperature is maintained in the load compartment, leads to a relatively even or uniform temperature distribution in the load compartment. This is highly beneficial in that the articles(s) subjected to the processing or treatment in the pressing arrangement may be subjected to the same, or substantially the same, temperature(s) during the treatment cycle, leading to a conformity in the processing of the article(s). The possibility of the present invention to provide a uniform heating may be particularly important in case relatively large load compartments are used, thereby avoiding that articles which are spaced apart in the load compartment are processed differently. Another benefit of the present invention is that the uniform heating may improve processes including precipitation hardening of the material of the article(s). More specifically, it should be noted that solution treatment before precipitation hardening processes may be sensitive to temperature fluctuations, which consequently may lead to deteriorated material properties of the treated articles. The present invention may overcome this problem by its innovative concept of providing a uniform heating during the treatment cycle.

The present invention is further advantageous in that the uniform and even heating and/or cooling may reduce the risk of an occurrence of internal stresses in the material of the article(s).

The present invention is further advantageous in that the uniform heating may increase the control of the heating phase of the treatment cycle.

It will be appreciated that the inventive heating concept of the present invention may furthermore lead to shorter treatment cycles of the pressing arrangement. This does not merely imply an ameliorated operation of the pressing arrangement considering time saved, but also leads to an improved cost-efficiency of the operation of the pressing arrangement.

There is provided a method for processing at least one article in a pressing arrangement. The pressing arrangement may be suitable for treatment of at least one article by means of pressing, for example hot pressing such as HIP. The pressing arrangement comprises a pressure vessel comprising a pressure cylinder, and a furnace chamber arranged within the pressure vessel for heating a pressure medium. The pressure medium used in the pressing arrangement may for example comprise or be constituted by a fluid medium which may have a relatively low chemical affinity in relation to the article(s) to be treated in the pressing arrangement. The pressure medium may for example comprise a gas, for example an inert gas such as Argon gas. The furnace chamber comprises at least one heating element, and a load compartment for holding the at least one article, wherein the load compartment is arranged inside the furnace chamber. The pressing arrangement further comprises at least one flow generator for circulating pressure medium within the pressure vessel. By the term "flow generator", it is here meant substantially any element, device, arrangement or the like which is able to generate a flow (of pressure medium), such as a fan, ejector, circulation means, or the like.

The method comprises the step of increasing the temperature in the load compartment by the at least one heating element in the furnace chamber. The method further comprises the step of maintaining or holding the increased temperature at a predetermined temperature level for a selected period of time. During the steps of increasing the temperature and maintaining the increased temperature, the method further comprises the step of circulating the pressure medium within the pressure vessel by the at least one flow generator. In other words, the method comprises operating one or more flow generators when increasing the temperature and maintaining the increased temperature in the load compartment of the pressing arrangement.

According to an embodiment of the present invention, the method may further comprise, during the step of increasing the temperature, circulating the pressure medium within the pressure vessel by operating the at least one flow generator at a first rate. Furthermore, during the step of maintaining the increased temperature, the method is configured to circulate the pressure medium within the pressure vessel by operating the at least one flow generator at a second rate, wherein the second rate is lower than the first rate. By the term "rate", it is here meant an operating rate, e.g. revolutions per minute (rpm) of the flow generator(s). By operating the flow generator(s) at a second rate at the sub-phase of maintaining the increased temperature in the load compartment, wherein the second rate is lower than the first rate of operation of the flow generator(s) at the sub-phase of increasing the temperature, the second rate may be relatively low and/or kept at a minimum for maintaining the forced convection in the pressure vessel.

According to an embodiment of the present invention, the method may further comprise operating the at least one flow generator as a function of at least one property of the pressure medium. Hence, during the step of increasing the temperature and/or the step of maintaining the increased temperature in the pressure vessel, the method is configured to circulate the pressure medium within the pressure vessel by operating the at least one flow generator at a rate which is dependent on one or more fluid properties of the pressure medium. It will be appreciated that the fluid properties of the pressure medium may be dependent on various parameters such as the pressure and/or temperature of the pressure medium, the rate of the heating of the pressure medium, etc. Examples of fluid properties of the pressure medium may be the density, the heat (thermal) capacity and/or the thermal conductivity, etc., of the pressure medium. The present embodiment is advantageous in that the step of increasing the temperature and/or the step of maintaining the increased temperature in the pressure vessel may be controlled to an even higher degree.

According to an embodiment of the present invention, the method may further comprise, during the step of increasing the temperature, increasing the temperature with a rate of at least 10° C./min, preferably at least 30° C./min. The present embodiment is advantageous in that a relatively fast temperature increase may be obtained, whilst still providing the advantages of a uniform heating.

According to an embodiment of the present invention, the method may further comprise, during the step of increasing the temperature, maintaining the temperature difference in the load compartment within a temperature interval ΔT of 50° C., preferably 35° C., and most preferred 20° C. Hence, the embodiment of the method may provide a relatively small temperature difference in the load compartment during the step of increasing the temperature. The present embodiment is advantageous in that an even more uniform heating procedure may be provided in the pressing arrangement.

According to an embodiment of the present invention, the method may further comprise, during the step of maintaining the increased temperature, maintaining the temperature difference in the load compartment within a temperature interval ΔT of 8° C., preferably 5° C., and most preferred 2° C. The present embodiment is advantageous in that the method may achieve a relatively small temperature difference within the load compartment, leading to an even higher degree of uniform heating of the articles during a processing of the articles in the pressing arrangement.

According to an embodiment of the present invention, the method may further comprise the step of increasing the pressure in the load compartment. The method may furthermore comprise the step of maintaining the increased pressure at a predetermined pressure level, $P_1$, for a selected period of time, $t_3$. The step of maintaining the increased pressure in the load compartment may take place, but not necessarily, during the previously described step of maintaining the increased temperature in the load compartment. Hence, the method may comprise the combination of increasing the temperature and increasing the pressure, and subsequently maintaining the increased temperature and the increased pressure, wherein the method may concurrently operate the flow generator(s) to achieve a forced convection in the load compartment. The present embodiment is advantageous in that the benefits of a uniform heating as provided by the method may be conveniently provided in a pressing arrangement wherein a relatively high temperature and high pressure is provided, e.g. a pressing arrangement for HIP.

According to an embodiment of the present invention, the method may further comprise, after the steps of increasing the temperature and maintaining the increased temperature, decreasing the temperature in the load compartment. Hence, when the (high) pressure treatment of the article is finished, the article may need to be cooled before being subjected to any subsequent processing step or being removed, or unloaded, from the pressure vessel. It will be appreciated that characteristics of the cooling of the article for example the rate thereof may affect the metallurgical properties of the treated article. The present embodiment is advantageous in that the method may, in combination with the advantageous heating phase and holding phase as described, also provide an efficient and rapid cooling phase in the treatment cycle. The present embodiment is hereby advantageous both for the ability to achieve desired material properties of the article(s) as well as for the possibility to obtain a relatively short cooling cycle, thereby saving processing time and/or cost.

According to an embodiment of the present invention, the pressure vessel of the pressing arrangement may further comprise a top end closure and a bottom end closure. The method may further comprise circulating a pressure medium within the pressure vessel, whereby the pressure medium is arranged to pass through the load compartment, and guiding the pressure medium past at least one of the top end closure and the bottom end closure for a cooling of the pressure medium. It will be appreciated that the top end closure and/or the bottom end closure may act as a heat dissipator by transferring heat away from the pressure medium arranged to come into (thermal) contact with the top end closure and/or bottom end closure. The present embodiment is advantageous in that a cooling of the pressure medium may be performed in a relatively fast and convenient manner by using the top end closure and/or bottom end closure as heat dissipators for the pressure medium.

According to an embodiment of the present invention, the pressing arrangement may comprise at least one element for cooling the pressure medium, and the method may further comprise the step of cooling the pressure medium by allowing pressure medium to pass through the at least one element. The present embodiment is advantageous in that the cooling phase in the treatment cycle may become even shorter and/or more efficient.

According to an embodiment of the present invention, the pressure vessel of the pressing arrangement may further comprise a top end closure and a bottom end closure, and at least one heat exchanging element arranged in at least one of the top end closure and the bottom end closure. The method may further comprise the step of circulating a pressure medium within the pressure vessel, whereby the pressure medium is arranged to pass through the load compartment. The method may further comprise the step of guiding the pressure medium through a passage of the at least one heat exchanging element for allowing a flow of pressure medium through the at least one heat exchanging element. The method may further comprise the step of circulating a cooling medium within the at least one heat exchanging element for a cooling of the pressure medium arranged to flow through the at least one heat exchanging element. The pressure medium is hereby arranged to pass through the load compartment and to pass through the top end closure and/or the bottom end closure of the pressing arrangement, in which one or more heat exchanging elements are arranged. It will be appreciated that the heat exchanging element according to the embodiment is an 'active' element in that cooling medium is conveyed to, within, and/or away from the heat exchanging element. The embodiment of the present invention is advantageous in that the cooling of the pressure medium is highly efficient by the active cooling by the circulation of cooling medium within the heat exchanging element(s). Hence, the efficient exchange of heat between the pressure medium and the cooling medium leads to a substantial and fast temperature decrease of the pressure medium, which in turn leads to a relatively fast cooling of the article(s) in the load compartment. The embodiment of the present invention is further advantageous in that it may lead to shorter pressure treatment cycles of the pressing arrangement. It should be noted that this does not merely imply an ameliorated operation of the pressing arrangement considering time saved, but may also lead to an improved cost-efficiency of the operation of the pressing arrangement.

According to an embodiment of the present invention, the pressure vessel of the pressing arrangement may further comprise a heat absorbing element arranged within the pressure vessel and configured to absorb heat from the pressure medium. The method may further comprise circulating pressure medium within the pressure vessel, whereby the pressure medium is arranged to pass through the heat absorbing element. The heat absorbing element, which in alternative could be referred to as a heat sink unit, or a heat exchanger unit, may be arranged entirely within the pressure vessel. The heat absorbing element may be a 'passive' element in the sense that the heat absorbing element may not be provided with any conduits, passages, channels or the like for conveying cooling medium to or from the heat absorbing element. The heat absorbing element may have no connection with the exterior of the pressure vessel. In particular, the heat absorbing element may have no fluid communication with the exterior of the pressure vessel. It will be appreciated that the heat exchanging element in the top end closure, in contrast, is an 'active' element in that cooling medium is conveyed to, within, and/or away from the heat exchanging element. The embodiment of the present invention is advantageous in that a relatively quick cooling of any article, which is placed in the load chamber, may be achieved to a required or desired temperature for example during a cooling phase of a treatment cycle. Further, by appropriately configuring for example the heat absorbing element with respect to its heat absorbing capacity or capability, it may be possible to achieve a relatively high rate of cooling of the article, e.g., during a cooling phase of a treatment cycle. It will be appreciated that there is a synergy effect between the concept of providing a heat absorbing element and a heat exchanging element for cooling purposes in a pressing arrangement. Hence, by a pressing arrangement comprising both a heat absorbing element and a heat exchanging element according to one or more of the embodiment described herein, an even more efficient cooling of the pressure medium may be obtained. Consequently, this may lead to an even more efficient and/or shorter cooling of a pressing treatment cycle in the pressing arrangement.

According to an embodiment of the present invention, the furnace chamber may be at least partly enclosed by a heat-insulated casing comprising a heat-insulating portion and a housing at least partly enclosing the heat-insulating portion. The pressing arrangement may further comprise a first flow generator arranged within the heat-insulated casing, and a second flow generator arranged beneath the heat-insulated casing. The method may further comprise the step of controlling a supply of pressure medium to at least one of the first flow generator and the second flow generator. The method may hereby control the supply of a first (warmer) part of the pressure medium and the supply of a second (colder) part of the pressure medium to the respective first and second flow generator. By the term "controlling a supply of pressure medium" it is hereby meant controlling the amount of pressure medium supplied (e.g. per time unit). The present embodiment is advantageous in that the control of temperature of the pressure medium within the pressing arrangement may be even further improved. For example, during a heating phase in the treatment cycle of the pressing arrangement, the control arrangement may be configured to stop any supply of pressure medium to a (second) flow generator configured to circulate relatively cold pressure medium. This may be achieved by closing one or more valves such that no, or a minimum, of (relatively cold) pressure medium is transported towards the flow generator. In combination herewith, the control arrangement may optionally be configured to open one or more valves for a supply of pressure medium to a (first) flow generator for a circulation of (relatively warm) pressure medium. In contrast, in case a relatively rapid cooling in the treatment cycle of the pressing arrangement is desired, the method may supply a relatively large portion of the second (colder) part of the pressure medium to the (second) flow generator, e.g. by (fully) opening one or more valves.

According to an embodiment of the present invention, the method may further comprise controlling the operation of at least one of the first flow generator and the second flow generator. The term "operation" may, in this context, mean speed, revolutions per minute, or the like, in case the flow generator is a fan. Alternatively, in case of an ejector as flow generator, the term "operation" may mean a flow rate. The present embodiment is advantageous in that the temperature of the pressure medium within the pressing arrangement may be controlled to an even further extent. For example, in case of a heating phase, the method may operate the first flow generator at a relatively high speed. Alternatively, in case a relatively rapid cooling in the treatment cycle of the pressing arrangement is desired, the method may operate the second flow generator at a relatively high speed.

According to an embodiment of the present invention, there is provided a method for high-pressure treatment of at least one article in a pressing arrangement comprising a pressure vessel comprising a pressure cylinder, a furnace chamber arranged within the pressure vessel for heating a pressure medium, wherein the furnace chamber comprises at least one heating element, and a load compartment for holding the at least one article, wherein the load compartment is arranged inside the furnace chamber, and at least one flow generator for circulating pressure medium within the pressure vessel. The method may comprise the sequential steps of arranging at least one article to be processed inside the load compartment, increasing the temperature in the load compartment and increasing the pressure in the load compartment. It should be noted that the steps of increasing the temperature and increasing the pressure in the load compartment may be performed simultaneously. The method may further comprise the step of maintaining the increased temperature at a predetermined temperature level, $T_1$, for a selected period of time, $t_1$, by performing the method according to one or more of the previously described embodiments, maintaining the increased pressure at a predetermined pressure level, $P_1$, for a selected period of time, $t_3$, and reducing the temperature in the load compartment by performing the method according to one or more of the previously described embodiments. Hence, the embodiment may relate to a hot pressing such as HIP, which further encompasses the treatment cycle phases of increasing the temperature and maintaining the temperature in the load compartment during which a pressure treatment is performed. After the (HIP) treatment, the (rapid) cooling is performed before the articles may be removed from the pressure vessel. The embodiment of the present invention is advantageous in that the method of (high) temperature and (high) pressure treatment may comprise the advantageous sub-phases of heating, maintaining, and cooling according to one of more of the previously described method embodiments, leading to an even more efficient treatment cycle.

According to an embodiment of the present invention, the above-mentioned method for high-pressure treatment may further comprise the step of controlling a supply of pressure medium according to the previously described embodiment describing this feature.

According to an embodiment of the present invention, the above-mentioned method for high-pressure treatment may further comprise the step of controlling the operation of at least one of the first flow generator and the second flow generator according to the previously described embodiment describing this feature.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the present invention will be described below with reference to the accompanying drawings.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments are provided by way of example so that this disclosure will convey the scope of the present invention to those skilled in the art.

Figure 1:
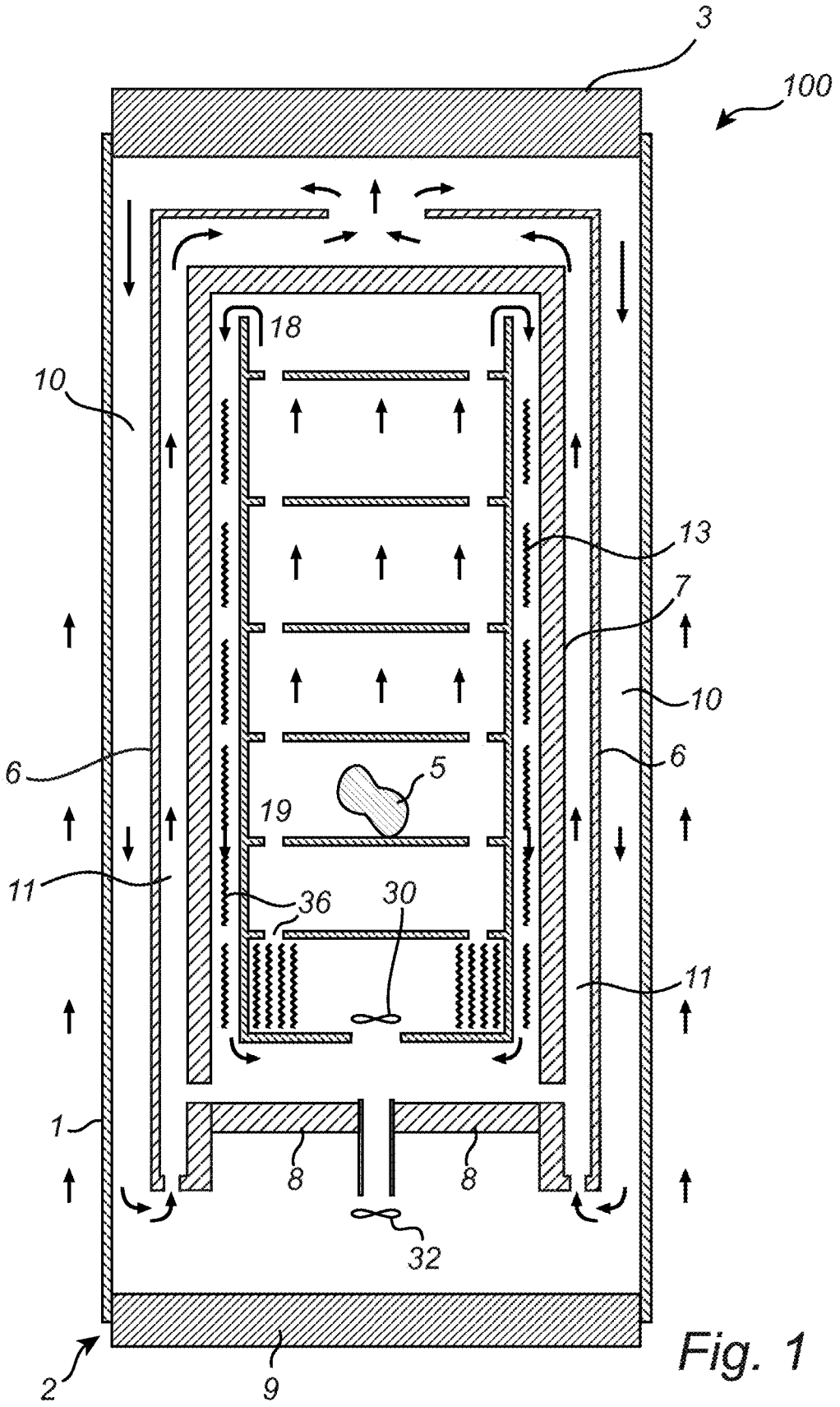
FIG. 1 is a schematic, in part sectional, side view of a pressing arrangement.

FIG. 1 is a schematic, in part sectional, side view of a pressing arrangement 100. The pressing arrangement 100 is intended to be used for pressing of at least one article, schematically indicated at reference numeral 5. The pressing arrangement 100 comprises a pressure vessel 2. Although not shown in FIG. 1, the pressure vessel 2 may comprise elements, means, modules, etc., such as one or more ports, inlets, outlets, valves, etc., for supplying and discharging pressure medium to and from the pressure vessel 2.

The pressure vessel 2 comprises a pressure cylinder 1, a top end closure 3 and a bottom end closure 9. The pressure vessel 2 comprises a furnace chamber 18. The furnace chamber 18 comprises a furnace, or heater or heating elements, for heating of the pressure medium in the pressure vessel for example during a pressing phase of a treatment cycle. The furnace is schematically indicated in FIG. 1 by the reference numeral 36. In accordance with the embodiment of the present invention illustrated in FIG. 1, the furnace 36 may be arranged at a lower portion of the furnace chamber 18. In alternative or in addition, the furnace 36 could be arranged in proximity to the inner side, or lateral, surfaces of the furnace chamber 18. It is to be understood that different configurations and arrangements of the furnace 36 in relation to, e.g., within, the furnace chamber 18 are possible. Any implementation of the furnace 36 with regard to an arrangement thereof in relation to, e.g., within, the furnace chamber 18 may be used in any one of the embodiments of the present invention described herein. In the context of the present application, the term "furnace" refers to the elements or means for providing heating, while the term "furnace chamber" refers to the area or region in which the furnace and possibly the load compartment and any article are located. As illustrated in FIG. 1, the furnace chamber 18 may not occupy the whole inner space of the pressure vessel 2, but may leave an intermediate space 10 of the interior of the pressure vessel 2 around the furnace chamber 18. The intermediate space 10 forms a pressure medium guiding passage 10. During operation of the pressing arrangement 100, the temperature in the intermediate space 10 may be lower than the temperature in the furnace chamber 18, but the intermediate space 10 and the furnace chamber 18 may be at equal, or substantially equal, pressure.

The outer surface of the outer walls of the pressure vessel 2 may be provided with channels, conduits or tubes, etc. (not shown), which channels, conduits or tubes for example may be arranged so as to be in connection with the outer surface of the outer wall of the pressure vessel 2 and may be arranged to run parallel to an axial direction of the pressure vessel 2. A coolant for cooling of the walls of the pressure vessel 2 may be provided in the channels, conduits or tubes, whereby the walls of the pressure vessel 2 may be cooled in order to protect the walls from detrimental heat building up during operation of the pressure vessel 2. The coolant in the channels, conduits or tubes may for example comprise water, but another or other types of coolants are possible. An exemplifying flow of coolant in channels, conduits or tubes provided on the outer surface of the outer walls of the pressure vessel 2 is indicated in FIG. 1 by the arrows on the outside of the pressure vessel 2.

Even though it is not explicitly indicated in any of the figures, the pressure vessel 2 may be arranged such that it can be opened and closed, such that any article 5 within the pressure vessel 2 may be inserted or removed. An arrangement of the pressure vessel 2 such that it can be opened and closed may be realized in a number of different manners, as known in the art. Although not explicitly indicated in FIG. 1, one or both of the top end closure 3 and the bottom end closure 9 may be arranged so that it can be opened and closed.

The furnace chamber 18 is enclosed by a heat insulated casing 6, 7, 8, and is arranged so that pressure medium can enter and exit the furnace chamber 18. In accordance with the embodiment of the present invention illustrated in FIG. 1, the heat insulated casing 6, 7, 8 comprises a heat insulating portion 7, a housing 6 which is partly enclosing the heat insulating portion 7, and a bottom insulating portion 8. Although the heat insulated casing is collectively referred to by the reference numerals 6, 7, 8, not all of the elements of the heat insulated casing 6, 7, 8 may be arranged so as to be heat insulated or heat insulating. For example, the housing 6 may not be arranged so as to be heat insulated or heat insulating.

A first guiding passage 13 is formed on the inside of the heat insulating portion 7, between the heat-insulated portion 7 and a wall of the load compartment 19, and is arranged to guide pressure medium downwards which has passed through the load compartment 19. A guiding passage 11 is formed between the heat insulating portion 7 and the housing 6. As illustrated in FIG. 1, the guiding passages 10, 11, 13 are arranged to form at least a part of a loop within the pressure vessel 2. The flow of pressure medium during a phase of a treatment cycle is illustrated by the arrows within the pressure vessel 2 shown in FIG. 1. A part of the loop comprises the pressure medium guiding passage 11 formed between portions of the housing 6 and the heat insulating portion 7, respectively. The pressure medium guiding passage 11 is arranged to guide the pressure medium after having exited the furnace chamber 18 towards the top end closure 3.

The pressing arrangement in FIG. 1 further comprises a first flow generator 30 arranged within the heat-insulated casing 6, 7, 8. Here, the first flow generator 30 is exemplified as a fan or the like for circulation of pressure medium within the furnace chamber 18. The guiding passage 13 is in fluid communication with the first flow generator 30, such that pressure medium from the guiding passage 13 may re-enter the load compartment via the first flow generator 30. The pressing arrangement 100 further comprises a second flow generator 32 arranged beneath the heat-insulated casing 8. Analogously with the first flow generator 30, the second flow generator 32 is also exemplified as a fan or the like for circulation of pressure medium. The second flow generator 32 is in fluid communication with the first flow generator 30 such that pressure medium circulated by the second flow generator 32 is fed to the first flow generator 30 for further feeding into the load compartment 19 of the pressing arrangement 100.

Figure 2A:
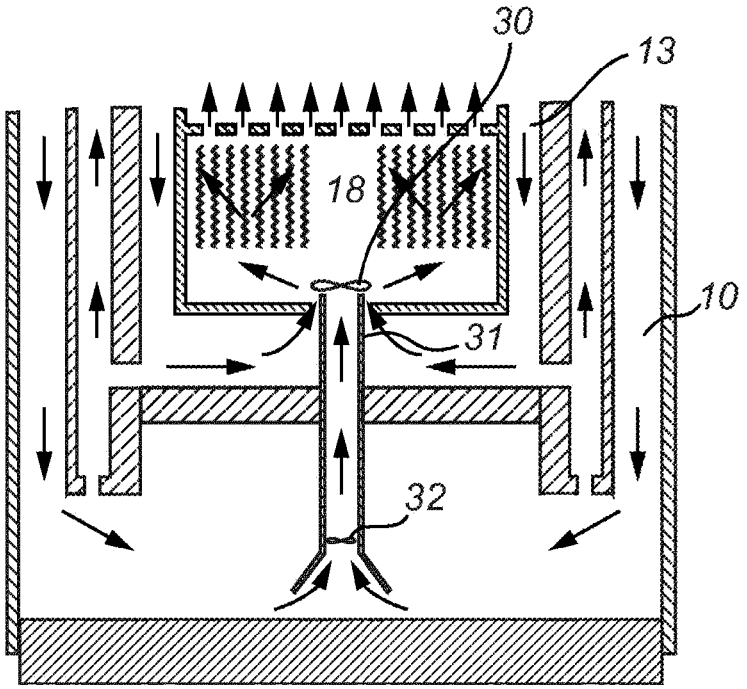
FIGS. 2*a-b* are schematic, in part sectional, side views of a bottom portion of a pressing arrangement.
Figure 2B:
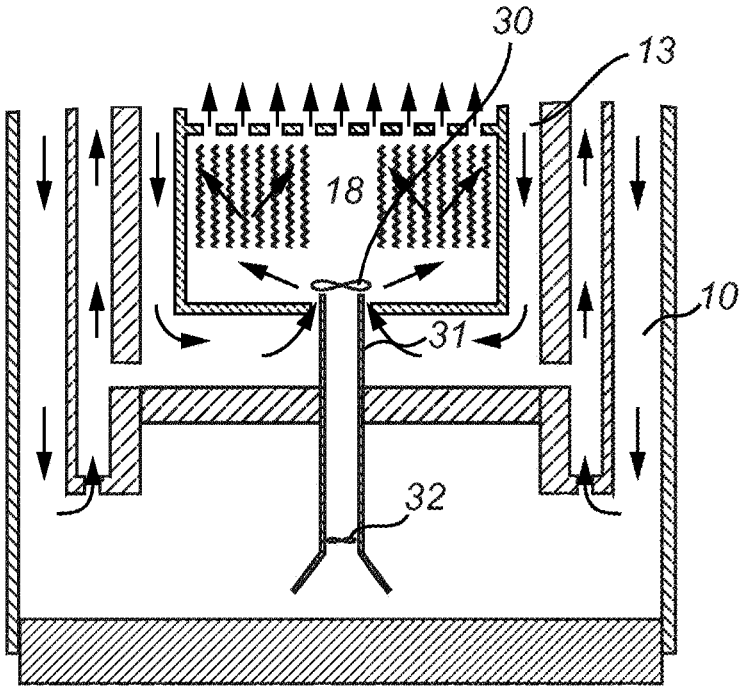

FIGS. 2*a-b* are schematic, in part sectional, side views of a bottom portion of a pressing arrangement 100, e.g. as described and disclosed in FIG. 1.

FIG. 2*a* describes the flow of pressure medium during a cooling stage or phase of the treatment cycle of the pressing arrangement and FIG. 2*b* describes the flow of pressure medium during a heating stage or phase of the treatment cycle of the pressing arrangement. In FIGS. 2*a-b*, the pressing arrangement comprises a first flow generator 30 arranged within the heat-insulated casing. Here, the first flow generator 30 is exemplified as a fan or the like for circulation of pressure medium within the furnace chamber 18. In accordance with the embodiment of the present invention illustrated in FIG. 1, the fan 30 may for example be arranged at the above-mentioned opening in the bottom insulating portion. The first guiding passage 13 is in fluid communication with the first flow generator 30, such that pressure medium from the guiding passage 13 may re-enter the load compartment 19 via the first flow generator 30. The pressing arrangement 100 further comprises a second flow generator 32 arranged beneath the heat-insulated casing. Analogously with the first flow generator 30, the second flow generator 32 is also exemplified as a fan or the like for circulation of pressure medium. The second flow generator 32 is in fluid communication with the first flow generator 30 via a tube 31 such that pressure medium circulated by the second flow generator 32 is fed to the first flow generator 30 for further feeding into the load compartment of the pressing arrangement.

In FIG. 2*a*, which describes the flow during a cooling stage or phase of the treatment cycle of the pressing arrangement, pressure medium that is guided in the second guiding passage 10 back towards the furnace chamber 18 may enter a space between the furnace chamber 18—or the bottom insulating portion—and the bottom end closure. It will be appreciated that pressure medium which has passed through the second guiding passage 10, in which the pressure medium may have been further cooled by being led in proximity to the inner surface of walls of the pressure cylinder, may have a relatively low temperature. Hence, pressure medium of relatively low temperature may be transported, via the second flow generator 32, towards the first flow generator 30 for further transportation into the load compartment. The pressing arrangement 100 may further comprise a control arrangement (not shown) configured to control a supply of pressure medium from the first guiding passage 13 to the first flow generator 30 and to control a supply of pressure medium from the second guiding passage 10 to the second flow generator 32. The control arrangement may be further configured to control the operation (e.g. revolutions per minute, rpm) of the first flow generator 30 and/or the second flow generator 32. For example, in case a relatively rapid cooling in the treatment cycle of the pressing arrangement is desired, the control arrangement may be configured to supply a relatively large portion of the relatively cold pressure medium from the guiding passage 10 towards the load compartment via the second flow generator 32, e.g. by (fully) opening one or more valves.

In FIG. 2*b*, which describes the flow during a heating stage or phase of the treatment cycle of the pressing arrangement, the control arrangement may be configured to stop any supply of pressure medium to the second flow generator 32 by closing one or more valves such that no, or a minimum, of (relatively cold) pressure medium is transported through the tube 31 towards the first flow generator 30. In combination herewith, the control arrangement may optionally be configured to open one or more valves for a supply of pressure medium to the first flow generator 30 for a circulation of (relatively warm) pressure medium. Hence, only pressure medium from the guiding passage 13 may be drawn into the first flow generator 30 and further transported in the load compartment of the pressing arrangement.

Figure 3:
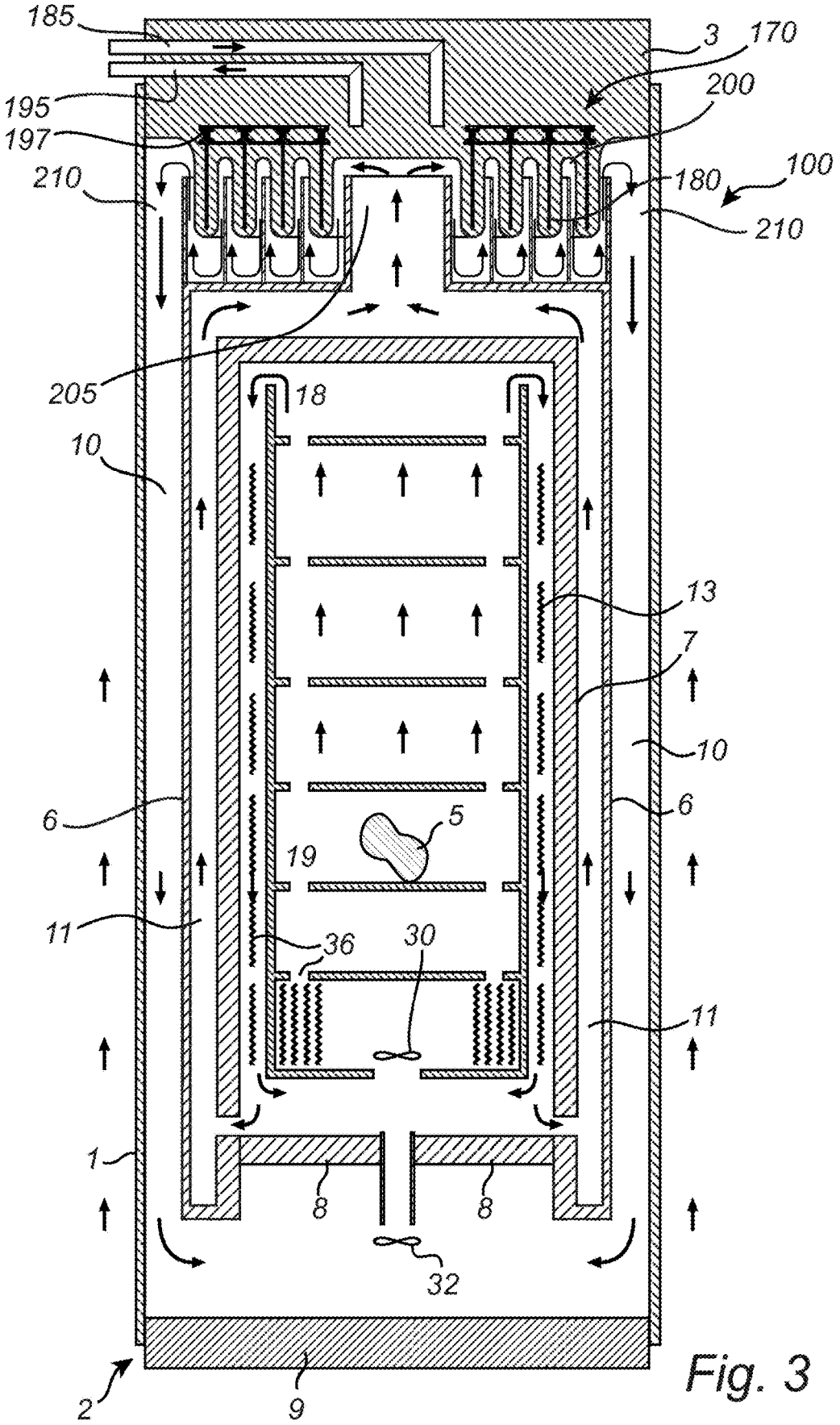
FIG. 3 is a schematic, in part sectional, side view of a pressing arrangement.

FIG. 3 is a schematic, in part sectional, side view of a pressing arrangement 100 according to an exemplifying embodiment. It will be appreciated that the pressing arrangement 100 as shown has many features and components in common with the pressing arrangement shown in FIG. 1, and it is hereby referred to FIG. 1 for reasons of simplicity. In FIG. 3, a heat exchanging element 170 is arranged in the top end closure 3 of the pressing arrangement 100. The heat exchanging element 170 comprises a circuit 180 for allowing a circulation of cooling medium within the circuit 180 of the heat exchanging element 170 for a cooling of pressure medium arranged to pass through the heat exchanging element 170 in the top end closure 3. The pressure medium may, from the opening of the housing 6, pass through a passage 200 of the heat exchanging element 170 arranged in the top end closure 3. More specifically, the pressure medium may enter the passage 200 via an inlet 205 of the passage 200 at a central portion of the heat exchanging element 170, and exit the passage 200 via an outlet 210 at a peripheral portion of the heat exchanging element 170. Thereafter, the pressure medium may enter into the second guiding passage 10. It will be appreciated that pressure medium entering the heat exchanging element 170 may come into a relatively close thermal contact with the heat exchanging element 170 being cooled by the cooling medium passing through the circuit 180 thereof. Hence, the pressure medium may be cooled efficiently and/or quickly by the heat exchanging element 170. The circuit 180 of the heat exchanging element 170 comprises an inlet tube 185 which is fluidically connected to the circuit 180 via channels 197 for a supply of cooling medium to the circuit 180. Analogously, the circuit 180 comprises an outlet tube 195 fluidically connected to the circuit 180 for a discharge of cooling medium from the circuit 180. During operation of the heat exchanging element 170, the cooling medium is hereby arranged to circulate within the circuit 180 of the heat exchanging element 170 for a heat transfer or cooling of the pressure medium passing the top end closure 3. As the temperature of the cooling medium is significantly lower than the temperature of the pressure medium, there is a transfer of cold from the cooling medium to the pressure medium, or analogously, a transfer of heat from the pressure medium to the cooling medium. It will be appreciated that the heat exchanging element 170 as described in FIG. 3 is schematic, and that other configurations are possible. For example, the heat exchanging element 170 may alternatively be arranged in the bottom end closure 9 with the same or a similar circuit 180 as in the top end closure 3.

Figure 4:
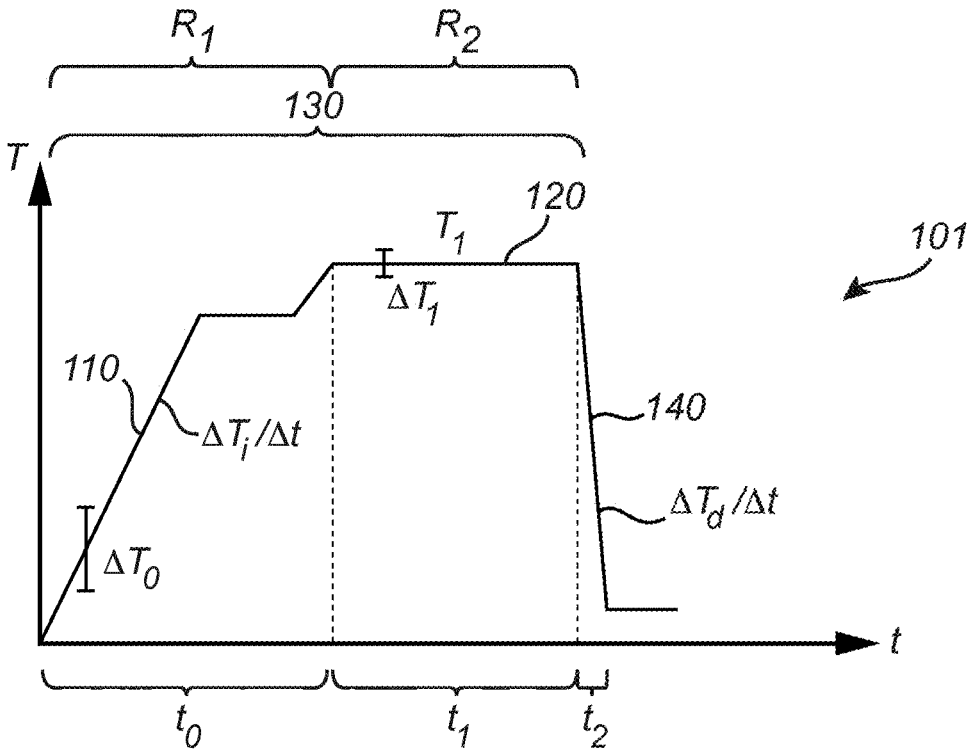
FIGS. 4-7 are schematic illustrations of methods according to embodiments of the present invention.

FIG. 4 is a schematic illustration of a method 101 according to an embodiment of the present invention for treatment of at least one article in a pressing arrangement 100, e.g. as exemplified in FIG. 1. First, the method 101 comprises the step of increasing 110 the temperature in the load compartment, in which one or more articles are arranged, by the at least one heating element in the furnace chamber. The method 101 may increase 110 the temperature during time $t_0$, wherein $t_0$ may be dependent on factors such as the material of the articles to be treated or processed, the size and/or configuration of the pressing arrangement, etc. The time to may, for example, be 5 hours, preferably 3 hours, and more preferably 1.5 hours.

The method 101 may increase 110 the temperature arbitrarily, i.e. in a non-specified manner. However, and according to a preferred embodiment, the method 101 may increase 110 the temperature in the load compartment with a rate (gradient) $\Delta T_i/\Delta t$ of at least 10° C./min, preferably at least 30° C./min. Furthermore, and also according to a preferred embodiment, the method 101 may, during the step of increasing 110 the temperature, maintain the temperature difference in the load compartment within a temperature interval $\Delta T_0$ of 50° C., preferably 35° C., and most preferred 20° C.

After the step of the method 101 of increasing 110 the temperature in the load compartment of the pressing arrangement 100, the temperature level $T_1$ within the load compartment may be 500-3000° C., preferably 1000-1400° C., and more preferably ca. 1200° C.

After the step of increasing 110 the temperature in the pressing arrangement 100, the method 101 may further comprise the step of maintaining 120 the (increased) temperature at the above-mentioned, predetermined temperature level $T_1$ for a selected period of time $t_1$. The selected period of time $t_1$ of maintaining $T_1$ may be 0.1-6 hours, preferably 0.5-4 hours, and more preferably 1-2 hours. According to a preferred embodiment, the method 101 may, during the step of maintaining 120 the increased temperature in the load compartment, maintain the temperature difference in the load compartment within a temperature interval $\Delta T_1$ of 8° C., preferably 5° C., and most preferred 2° C.

The method 101 may further comprise the step of decreasing 140 the temperature in the load compartment after the steps of increasing 110 the temperature and maintaining 120 the increased temperature in the pressing arrangement. The temperature in the load compartment may be decreased 140 during time $t_2$. The rate (gradient) $\Delta T_d/\Delta t$ of the temperature reduction (i.e. the cooling rate) may be at least 200° C./min, preferably at least 250° C./min, and more preferably at least 300° C./min.

During the steps of the method 101 of increasing 110 the temperature and maintaining 120 the increased temperature in the load compartment 19 of the pressing arrangement, as schematically indicated in FIG. 4, the method 101 further comprises circulating 130 the pressure medium within the pressure vessel by the at least one flow generator in the pressing arrangement. Hence, the method 101 comprises operating one or more of the flow generators both during the heating phase, in which the method 101 increases 110 the temperature in the load compartment, as well as during the holding phase, in which the method 101 maintains 120 the increased temperature in the load compartment. It will be appreciated that the method 101 hereby leads to a relatively even or uniform temperature distribution in the load compartment, both during the sub-phase of increasing 110 the temperature (heating phase) as well as during the sub-phase of maintaining 120 the increased temperature (holding phase). In other words, the difference $\Delta T_0$ in temperature in the load compartment of the pressing arrangement during the step of increasing 110 the temperature and the difference $\Delta T_1$ in temperature in the load compartment of the pressing arrangement during the step of maintaining 120 the temperature, may be relatively small by the inventive method of the present invention.

FIG. 4 shows a further embodiment of the method 101 of the present invention. Here, the pressure medium within the pressure vessel is circulated by operating the at least one flow generator at a first rate $R_1$ during the step of increasing 110 the temperature within the load compartment. Furthermore, the pressure medium within the pressure vessel is circulated by operating the at least one flow generator at a second rate $R_2$ during the step of maintaining 120 the temperature within the load compartment, wherein the second rate $R_2$ is lower than the first rate $R_1$, i.e. $R_2<R_1$. For example, the method 101 may operate one or more of the flow generators at rate $R_1$ during to and at rate $R_2$ during $t_1$. Furthermore, the method 101 may keep the second rate $R_2$ relatively low, e.g. at a minimum rate for maintaining the forced convention by the flow generator(s) in the pressure vessel. The method 101 may furthermore operate one or more of the flow generators at a rate as a function of the fluid properties of the pressure medium. Hence, during the step of increasing 110 the temperature and/or the step of maintaining 120 the increased temperature, the method may be configured to circulate the pressure medium within the pressure vessel by operating the flow generator(s) at (a) rate(s) which is dependent on the fluid properties of the pressure medium.

Figure 5:
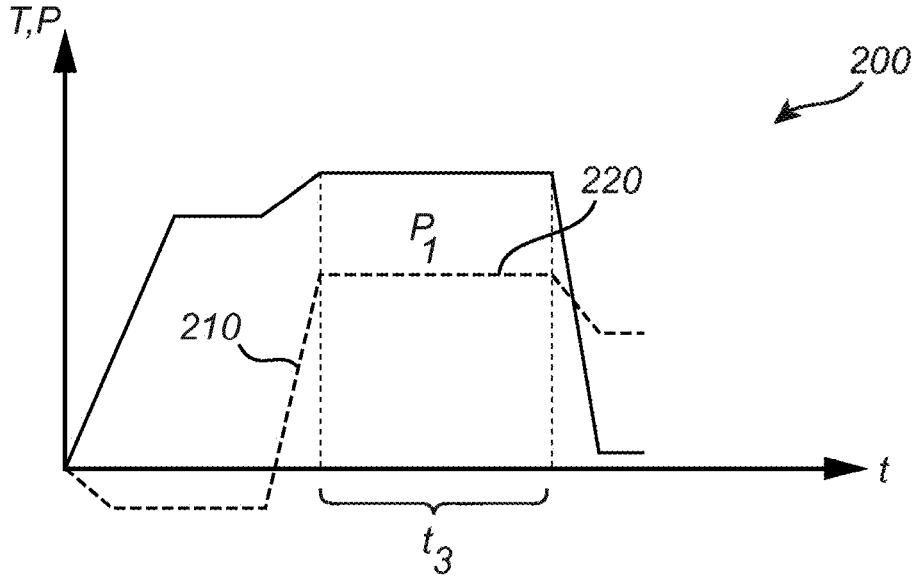

FIG. 5 is a schematic illustration of a method 200 according to an embodiment of the present invention for treatment of at least one article in a pressing arrangement 100, e.g. as exemplified in FIG. 1. Furthermore, it will be appreciated that the steps of the method 200 includes one or more of the steps of the method 101 as previously described in the text and by FIG. 4, and it is hereby referred to the mentioned text and figure for an increased understanding. Initially, i.e. at the leftmost portion of the T,P diagram of FIG. 5, the heating (i.e. increase in temperature T) is performed under vacuum, whereby the pressure P slightly decreases from the atmospheric pressure level. Thereafter, and in combination with the previously described steps of increasing, maintaining and/or cooling the temperature in the load compartment of the pressure vessel during operation of one or more flow generators, the method 200 further comprises the step of increasing 210 the pressure in the load compartment. The method 200 further comprises the step of maintaining 220 the increased pressure at a predetermined pressure level, $P_1$, for a selected period of time, $t_3$. The predetermined pressure $P_1$ may be 20-500 MPa, preferably 50-300 MPa, and more preferably 80-250 MPa. It will be appreciated that the step of maintaining 220 the pressure in the load compartment may be performed (but not necessarily) simultaneously with the previously described step of maintaining the temperature in the load compartment. In other words, the selected period of time $t_3$ of maintaining $P_1$ may correspond to the selected period of time $t_1$ of maintaining $T_1$ in the load compartment.

Figure 6:
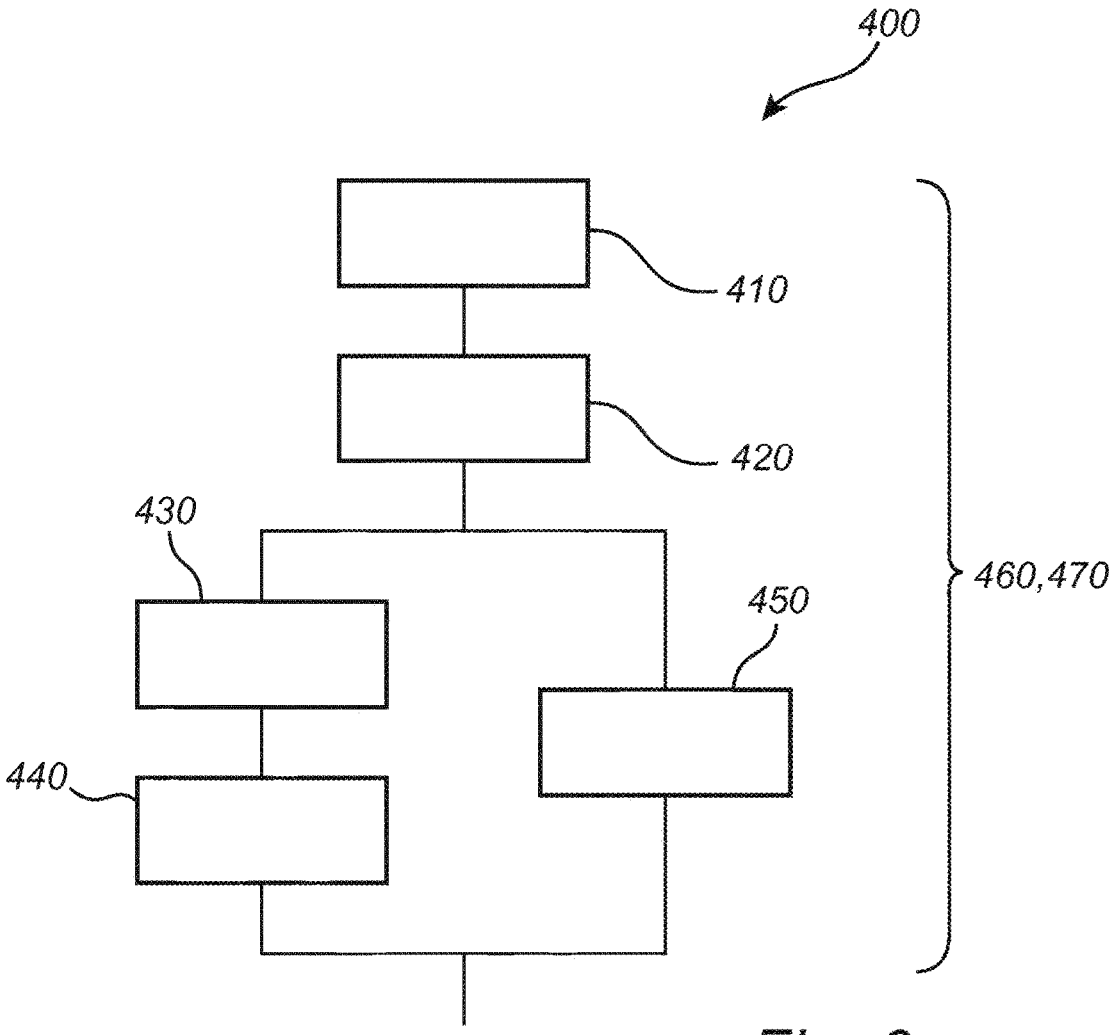

FIG. 6 is a schematic illustration of a method 400 according to one or more embodiments of the present invention for treatment of at least one article. The pressing arrangement, e.g. as exemplified in FIG. 1, may further comprise at least one element for cooling the pressure medium. Hence, after the steps of increasing the temperature and maintaining the increased temperature, the method 400 may comprise the step of decreasing 410 the temperature in the load compartment by means of the element(s). For example, the element may constitute or comprise a heat exchanging element arranged in the top end closure of the pressing arrangement as described in FIG. 3. More specifically, the heat exchanging element may comprise a circuit for allowing a circulation of cooling medium within the circuit of the heat exchanging element for a cooling of pressure medium arranged to pass through the heat exchanging element in the top end closure. The element may alternatively, or in combination herewith, constitute or comprise a heat exchanging element arranged in the bottom end closure of the pressing arrangement. Alternatively, or in combination herewith, the element may furthermore constitute or comprise a heat absorbing element arranged within the pressure vessel and configured to absorb heat from the pressure medium. The method 400 may further comprise the step of circulating 420 a pressure medium within the pressure vessel, whereby the pressure medium is arranged to pass through the load compartment. In case the pressing arrangement comprises a heat exchanging element arranged in the top end closure of the pressing arrangement, the method 400 may further comprise the step of guiding 430 the pressure medium through a passage of the heat exchanging element for allowing a flow of pressure medium through the heat exchanging element, and circulating 440 a cooling medium within the heat exchanging element for a cooling of the pressure medium arranged to flow through the heat exchanging element. Alternatively, or in combination with the heat exchanging element, the pressing arrangement may comprise a heat absorbing element arranged within the pressure vessel. The method 400 may thereby further comprise circulating 450 pressure medium within the pressure vessel, whereby the pressure medium is arranged to pass through the heat absorbing element.

The method 400 may further comprise the step of controlling 460 a supply of pressure medium to at least one of one or more flow generators during one or more of the steps 410, 420, 430, 440 and/or 450. The method 400 may furthermore comprise the step of controlling 470 the operation of at least one of the one or more flow generators during one or more of the steps 410, 420, 430, 440 and 450. According to the pressing arrangement 100 as exemplified in FIG. 1, pressure medium that is guided in the pressure medium guiding passage back towards the furnace chamber may enter a space between the furnace chamber—or the bottom insulating portion and the bottom end closure. It will be appreciated that pressure medium which has passed the heat exchanging element and passed through the second guiding passage, in which the pressure medium may have been further cooled by being led in proximity to the inner surface of walls of the pressure cylinder, may have a relatively low temperature. Hence, pressure medium of relatively low temperature may be transported, via the second flow generator, towards the first flow generator for further transportation into the load compartment. Hence, by the step of controlling 460 a supply of pressure medium to the first and/or second flow generators and/or the step of controlling the operation (e.g. revolutions per minute, rpm) of the first and/or second flow generators, an even more controlled and/or faster heating, holding, and/or cooling phase of the treatment cycle may be achieved by the method 400. For example, the method 400 may stop any supply of pressure medium to the second flow generator by closing one or more valves such that no, or a minimum, of (relatively cold) pressure medium is circulated. In combination herewith, the control arrangement may optionally be configured to open one or more valves for a supply of pressure medium to the first flow generator for a circulation of (relatively warm) pressure medium.

Figure 7:
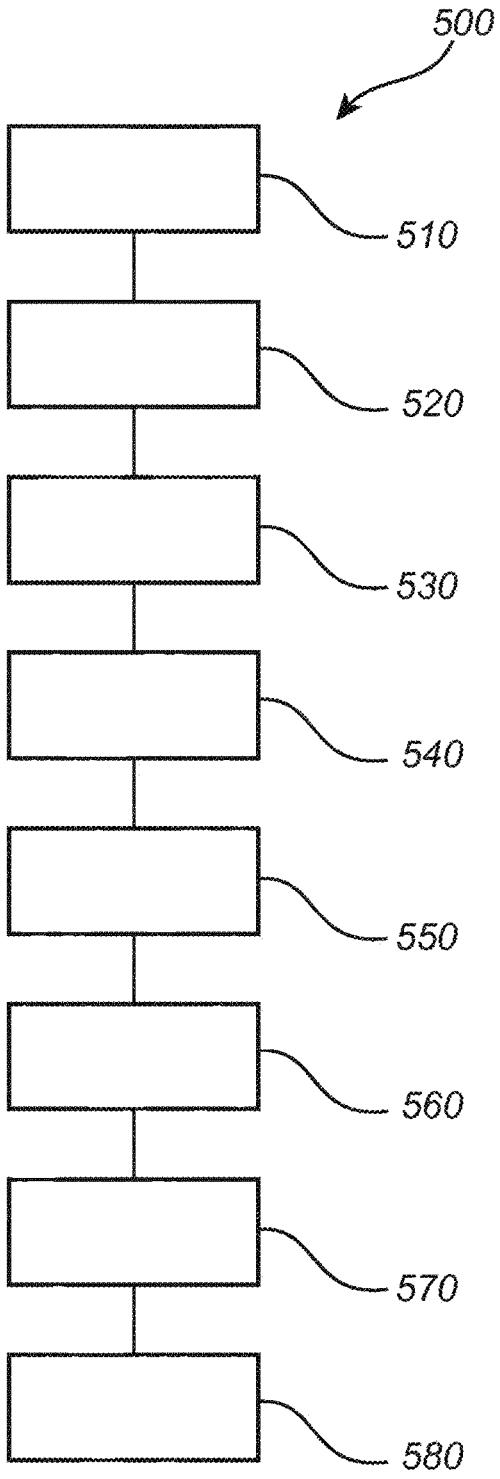

FIG. 7 is a schematic illustration of a method 500 according to one or more embodiments of the present invention for treatment of at least one article. The method 500 may first comprise the step of arranging 510 at least one article to be processed inside the load compartment of a pressing arrangement. The method 500 may thereafter comprise the steps of increasing 520 the temperature in the load compartment and increasing 530 the pressure in the load compartment. It should be noted that the steps of increasing 520 the temperature and increasing the pressure 530 in the load compartment may be performed simultaneously. The method 500 further comprises the step of maintaining 540 the increased temperature at a predetermined temperature level $T_1$ for a selected period of time $t_1$ by performing at least one step of one or more of the previously described methods 100, 200, 400. The method 500 may further comprise the steps of maintaining 550 the increased pressure at a predetermined pressure level $P_1$ for a selected period of time $t_3$. The steps of maintaining 540 the increased temperature and maintaining 550 the increased pressure may be performed simultaneously, i.e. the selected period of time $t_3$ of maintaining $P_1$ may correspond to the selected period of time $t_1$ of maintaining $T_1$ in the load compartment. The method 500 may further comprise the step of reducing 560 the temperature in the load compartment by performing at least one step of one or more of the previously described methods 100, 200, 400. The method 500 may further comprise controlling 570 a supply of pressure medium and/or controlling 580 the operation of at least one of the first and second flow generators.

In conclusion, a method for processing at least one article in a pressing arrangement is disclosed. The pressing arrangement comprises a pressure vessel comprising a pressure cylinder, and a furnace chamber arranged within the pressure vessel for heating a pressure medium. The furnace chamber comprises at least one heating element, and a load compartment for holding the at least one article, wherein the load compartment is arranged inside the furnace chamber. The pressing arrangement further comprises at least one flow generator for circulating pressure medium within the pressure vessel. The method comprises the step of increasing the temperature in the load compartment by the at least one heating element in the furnace chamber. The method further comprises the step of maintaining the increased temperature at a predetermined temperature level for a selected period of time. During the steps of increasing the temperature and maintaining the increased temperature, the method further comprises the step of circulating the pressure medium within the pressure vessel by the at least one flow generator.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A method for processing at least one article in a pressing arrangement, the pressing arrangement including a pressure vessel including a pressure cylinder, a furnace chamber arranged within the pressure vessel for heating a pressure medium, wherein the furnace chamber includes at least one heating element, and a load compartment for holding the at least one article, wherein the load compartment is arranged inside the furnace chamber, and at least one flow generator for circulating pressure medium within the pressure vessel, wherein the method comprises:

increasing a temperature in the load compartment by controlling the at least one heating element in the furnace chamber;

maintaining the increased temperature at a predetermined temperature level for a first selected period of time; and during the increasing the temperature and the maintaining the increased temperature, circulating the pressure medium within the pressure vessel by controlling the at least one flow generator, wherein the method further includes during the increasing the temperature, circulating the pressure medium within the pressure vessel by controlling the at least one flow generator to operate at a first rate of revolutions per minute, and during the maintaining the increased temperature, circulating the pressure medium within the pressure vessel by controlling the at least one flow generator to operate at a second rate of revolutions per minute being lower than the first rate of revolutions per minute while maintaining forced convection within the pressure vessel.

2. The method according to claim 1, further comprising:

during the increasing the temperature, increasing the temperature with a rate of at least 10° C./min.

3. The method according to claim 1, further comprising:

during the increasing the temperature, maintaining a temperature difference in the load compartment within a temperature interval of 50° C.

4. The method according to claim 1, further comprising:

during the maintaining the increased temperature, maintaining a temperature difference in the load compartment within a temperature interval of 8° C.

5. The method according to claim 1, further comprising:

increasing a pressure in the load compartment; and maintaining the increased pressure at a predetermined pressure level for a second selected period of time.

6. The method according to claim 1, further comprising:

after the increasing the temperature and the maintaining the increased temperature, decreasing the temperature in the load compartment.

7. The method according to claim 1, wherein the pressing arrangement includes at least one element for cooling the pressure medium, and the method further includes cooling the pressure medium by allowing pressure medium to pass through the at least one element.

8. The method according to claim 7, wherein the pressure vessel of the pressing arrangement further includes a top end closure, a bottom end closure, and at least one heat exchanging element arranged in at least one of the top end closure and the bottom end closure, and the method further includes circulating the pressure medium within the pressure vessel, whereby the pressure medium is arranged to pass through the load compartment, guiding the pressure medium through a passage of the at least one heat exchanging element for allowing a flow of pressure medium through the at least one heat exchanging element, and circulating a cooling medium within the at least one heat exchanging element for a cooling of the pressure medium arranged to flow through the at least one heat exchanging element.

9. The method according to claim 7, wherein the pressure vessel of the pressing arrangement further includes a heat absorbing element arranged within the pressure vessel and configured to absorb heat from the pressure medium, and the method further includes circulating pressure medium within the pressure vessel, whereby the pressure medium is arranged to pass through the heat absorbing element.

10. The method according to claim 1, wherein the furnace chamber is at least partly enclosed by a heat-insulated casing comprising a heat-insulating portion and a housing at least partly enclosing the heat-insulating portion, the pressing arrangement further includes a first flow generator arranged within the heat-insulated casing, and a second flow generator arranged beneath the heat-insulated casing, and the method further includes controlling a supply of pressure medium to at least one of the first flow generator and the second flow generator.

11. A method for high-pressure treatment of at least one article in a pressing arrangement, the pressing arrangement including a pressure vessel comprising a pressure cylinder, a furnace chamber arranged within the pressure vessel for heating a pressure medium, wherein the furnace chamber includes at least one heating element, and a load compartment for holding the at least one article, wherein the load compartment is arranged inside the furnace chamber, and at least one flow generator for circulating pressure medium within the pressure vessel, wherein the method comprises:

arranging at least one article to be processed inside the load compartment;

increasing a temperature in the load compartment by controlling the at least one heating element in the furnace chamber, and increasing a pressure in the load compartment;

maintaining the increased temperature at a predetermined temperature level for a first selected period of time;

maintaining the increased pressure at a predetermined pressure level for a second selected period of time;

reducing the temperature in the load compartment; and during the increasing the temperature and maintaining the increased temperature, circulating the pressure medium within the pressure vessel by controlling the at least one flow generator, wherein the method further includes during the increasing the temperature, circulating the pressure medium within the pressure vessel by controlling the at least one flow generator to operate at a first rate of revolutions per minute, and during the maintaining the increased temperature, circulating the pressure medium within the pressure vessel by controlling the at least one flow generator to operate at a second rate of revolutions per minute being lower than the first rate of revolutions per minute while maintaining forced convection within the pressure vessel.

12. The method according to claim 11, wherein the furnace chamber is at least partly enclosed by a heat-insulated casing comprising a heat-insulating portion and a housing at least partly enclosing the heat-insulating portion, the pressing arrangement further includes a first flow generator arranged within the heat-insulated casing, and a second flow generator arranged beneath the heat-insulated casing, and the method further includes controlling a supply of pressure medium to at least one of the first flow generator and the second flow generator.

* * * * *